US008926444B2

(12) United States Patent
Kato et al.

(10) Patent No.: US 8,926,444 B2
(45) Date of Patent: Jan. 6, 2015

(54) GOLF CLUB

(71) Applicants: Dunlop Sports Co. Ltd., Kobe, Hyogo (JP); Sumitomo Rubber Industries, Ltd., Kobe, Hyogo (JP)

(72) Inventors: Masatoshi Kato, Kobe (JP); Masahiko Ueda, Kobe (JP)

(73) Assignees: Dunlop Sports Co. Ltd., Kobe (JP); Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 13/870,560

(22) Filed: Apr. 25, 2013

(65) Prior Publication Data

US 2013/0288812 A1 Oct. 31, 2013

(30) Foreign Application Priority Data

Apr. 26, 2012 (JP) ..... 2012-101630

(51) Int. Cl.

| | |
|---|---|
| ***A63B 69/36*** | (2006.01) |
| ***A63B 53/14*** | (2006.01) |
| ***A63B 59/00*** | (2006.01) |
| *A63B 24/00* | (2006.01) |

(52) U.S. Cl.

CPC ..... *A63B 69/3632* (2013.01); *A63B 53/14* (2013.01); *A63B 59/0033* (2013.01); *A63B 59/0088* (2013.01); *A63B 59/0092* (2013.01); *A63B 24/0003* (2013.01); *A63B 2069/3605* (2013.01); *A63B 2220/34* (2013.01); *A63B 2220/40* (2013.01); *A63B 2220/80* (2013.01); *A63B 2220/833* (2013.01); *A63B 2225/50* (2013.01)

USPC ..... 473/202; 473/223

(58) Field of Classification Search

USPC ..... 473/131, 202, 221, 222, 223, 233, 407, 473/283

See application file for complete search history.

(56) References Cited

U.S. PATENT DOCUMENTS

| | | | | |
|---|---|---|---|---|
| 6,753,778 | B2 * | 6/2004 | Kruger | 340/568.6 |
| 7,800,480 | B1 * | 9/2010 | Joseph et al. | 340/10.1 |
| 8,272,970 | B2 * | 9/2012 | Balardeta et al. | 473/222 |
| 2006/0025229 | A1 * | 2/2006 | Mahajan et al. | 473/131 |
| 2009/0233735 | A1 * | 9/2009 | Savarese et al. | 473/407 |
| 2011/0224012 | A1 * | 9/2011 | Hashimoto et al. | 473/223 |
| 2012/0035003 | A1 * | 2/2012 | Moran et al. | 473/407 |
| 2012/0052973 | A1 * | 3/2012 | Bentley | 473/223 |
| 2013/0065703 | A1 * | 3/2013 | Rose | 473/223 |

FOREIGN PATENT DOCUMENTS

| | | | |
|---|---|---|---|
| JP | 2010-187749 | A | 9/2010 |
| JP | 2010-276493 | A | 12/2010 |
| JP | 2011-72518 | A | 4/2011 |
| KR | 10-2011-0101628 | A | 7/2012 |

* cited by examiner

*Primary Examiner* — Nini Legesse

(74) *Attorney, Agent, or Firm* — Birch, Stewart, Kolasch & Birch, LLP

(57) ABSTRACT

A golf club having a head disposed at a front end of a shaft and having a grip disposed at a back end of the shaft. The golf club includes a sensor section arranged on a grip-end edge of the grip and used for analyzing action of a golf swing.

8 Claims, 7 Drawing Sheets

GOLF CLUB

TECHNICAL FIELD

The present invention relates to a golf club. In more detail, the present invention relates to a golf club having attached thereto a sensor for analyzing a swing of a golfer.

BACKGROUND ART

For golfers, it is an eternal theme to extend flight distance of a ball and shoot the ball at an aimed direction and angle. Therefore, it is important to use a golf club suited for one's own swing.

Selecting a golf club suited for a golfer is generally referred to as fitting, and, when performing the fitting, it is proposed to ask a golfer to actually swing a golf club and perform the fitting from a measurement result of the swing.

Furthermore, in addition to methods for measuring a swing using a television camera and optical detection means that are separate from a golf club, methods for conducting measurements by attaching various sensors to the golf club itself are known (e.g., cf. Patent Literatures 1 and 2).

Patent Literature 1 discloses providing an acceleration sensor and strain gauge on a shaft of a golf club for analyzing a swing of a golfer. Furthermore, Patent Literature 2 discloses mounting, on a shaft of a golf club, a measuring instrument including a gyro sensor or an acceleration sensor as a sensor.

CITATION LIST

Patent Literature

[PTL 1] Japanese Laid-Open Patent Publication No. 2010-187749

[PTL 2] Japanese Laid-Open Patent Publication No. 2011-72518

SUMMARY OF INVENTION

Technical Problem

Although the method disclosed in Patent Literature 1 can measure action of the golf club shaft at a specific site, since the sensor is mounted on the shaft, the measurement is easily affected by influences of flexure and vibration of the shaft during a swing and by influence at the time of impact, so that accuracy of measurement values may deteriorate. In addition, since a casing that houses the sensor is large and heavy, and upsets club balance, a problem arises where the golfer cannot perform a natural swing.

In addition, in the method disclosed in Patent Literature 2, a measuring instrument is large-sized and may obstruct a swing. Furthermore, although it also discloses mounting the measuring instrument to an arm, since influence of wrist motion on shaft action cannot be measured when the measuring instrument is mounted on the arm, it is difficult to analyze accurate swing action and swing characteristics of the golfer.

The present invention has been made in view of such circumstances, and an objective of the present invention is to provide a golf club capable of analyzing overall swing action of a golf club and improving accuracy of the analysis without being influenced by deformation etc., of a shaft during the swing.

Solution to the Problems (1) A golf club of the present invention is a golf club having a head disposed at a front end of a shaft and having a grip disposed at a back end of the shaft, the golf club including:

a sensor section arranged on a grip-end edge of the grip and used for analyzing action of a golf swing.

With the golf club of the present invention, since the sensor is arranged at the grip-end edge of the grip, measurement is not influenced by deformation etc., of the shaft during a swing. As a result, accuracy of the measurement and therefore accuracy of the analysis of a swing can be improved. In addition, since the sensor is mounted on the grip end, influences of factors (e.g., vibration of the shaft caused by the swing, etc.,) other than the swing can be reduced, and motion of the grip can be measured in a linear manner. Thus, action (flexure) of the shaft during a swing can be analyzed with fine accuracy.

(2) Preferably in the golf club of (1), the total weight of the grip and the sensor section is not larger than 55 g. In this case, since the weight is not different from that of a general grip, a golfer can conduct a swing as usual, and reliability of the swing analysis can be increased.

(3) Preferably in the golf club of (1), the weight of the sensor section is not larger than 15 g. In this case, by adopting a specification in which the weight of the grip is slightly light, it is possible to set the total weight of the sensor section and the grip to the same level as the weight of a general grip end. With this, since a golfer can conduct a swing as usual, reliability of the swing analysis can be increased.

(4) Possibly in the golf club of (1), the sensor section includes at least one of an angular velocity sensor, an acceleration sensor, and a magnetic sensor, and a sensor casing that houses the sensor.

(5) Preferably, the golf club of (4) further comprises a temperature sensor. In this case, since it is possible to correct, using temperature, measurement value from the angular velocity sensor or the like based on measurement value from the temperature sensor, accuracy of the measurement value can be improved.

(6) Preferably in the golf club of (4), the sensor casing has a shape of a short cylinder arranged concentrically to an axial center of the shaft, and an outer diameter of the short cylinder is smaller than a diameter of the grip-end edge. In this case, since the thickness of the sensor section is smaller than that of the grip, the sensor section will not be obstructive to the gripping when the grip is grasped, and since the sensor section will not be obstructive during a swing, a smooth swing can be conducted. As a result, since a golfer can conduct a swing as usual, reliability of the swing analysis can be increased.

(7) Preferably in the golf club of (4), the sensor casing is formed from a synthetic resin whose Rockwell hardness is R90 to 130. In this case, it is possible to reduce weight of the casing while maintaining certain level of strength.

(8) Preferably in the golf club of (4), a front-end bulged part is formed on one end surface of the sensor casing, and an engagement concavity for housing and fixing the front-end bulged part is formed at the grip-end edge. In this case, it is possible to fix the sensor section on the grip-end edge by only inserting the front-end bulged part into the engagement concavity at the grip-end edge.

(9) Preferably in the golf club of (4), a pin capable of piercing the grip-end edge is disposed at one end surface of the sensor casing in a protruding manner. In this case, by having the pin pierce the grip-end edge, rotational movement of the sensor section can be prevented. It is possible to form, on the grip-end edge, a hole whose diameter is smaller than that of the pin so as to have the pin pierce this hole, or it is possible to have the pin directly pierce the grip-end edge.

(10) Preferably in the golf club of (9), a plurality of the pins are disposed in a protruding manner on an area surrounding a front-end bulged part formed on one end surface of the sensor casing. By disposing the plurality of the pins in a protruding manner, effect of preventing rotation of the sensor section can be obtained with further certainty.

(11) Preferably in the golf club of (1), a buffer part is disposed between the shaft and the sensor section for reducing shock generated when hitting a ball. In this case, it is possible to suppress shock generated in the golf club when hitting a ball for swing analysis from being transferred to the sensor of the sensor section. As a result, accuracy of the measurement result can be improved.

(12) Possibly in the golf club of (11), the buffer part is formed by a large-thickness part of a grip-end side edge part of the grip. In this case, by increasing the thickness of the grip-end side edge part, it is possible to, because of this large-thickness part and without using a separate member, suppress shock generated in the golf club when hitting a ball for swing analysis from being transferred to the sensor of the sensor section. As a result, accuracy of the measurement result can be improved.

(13) Possibly in the golf club of (11), the buffer part is formed from a buffer material arranged between the grip-end edge and a sensor casing of the sensor section. In this case, with the buffer material, it is possible to suppress shock generated in the golf club when hitting a ball for swing analysis from being transferred to the sensor of the sensor section. As a result, accuracy of the measurement result can be improved.

(14) Preferably in the golf club of (12) or (13), the large-thickness part or the buffer material is formed from a material whose shore A hardness is not smaller than 40° but not larger than 60°. In this case, by having a suitable hardness for the large-thickness part or the buffer material, it is possible to suppress vibration of the large-thickness part or the buffer material itself, and effectively prevent shock generated in the golf club when hitting a ball from being transferred to the sensor section.

Advantageous Effects of the Invention

With the golf club of the present invention, it is possible to analyze overall swing action of a golf club and improve accuracy of the analysis without being influenced by deformation etc., of a shaft during the swing.

DESCRIPTION OF EMBODIMENTS

Figure 1:
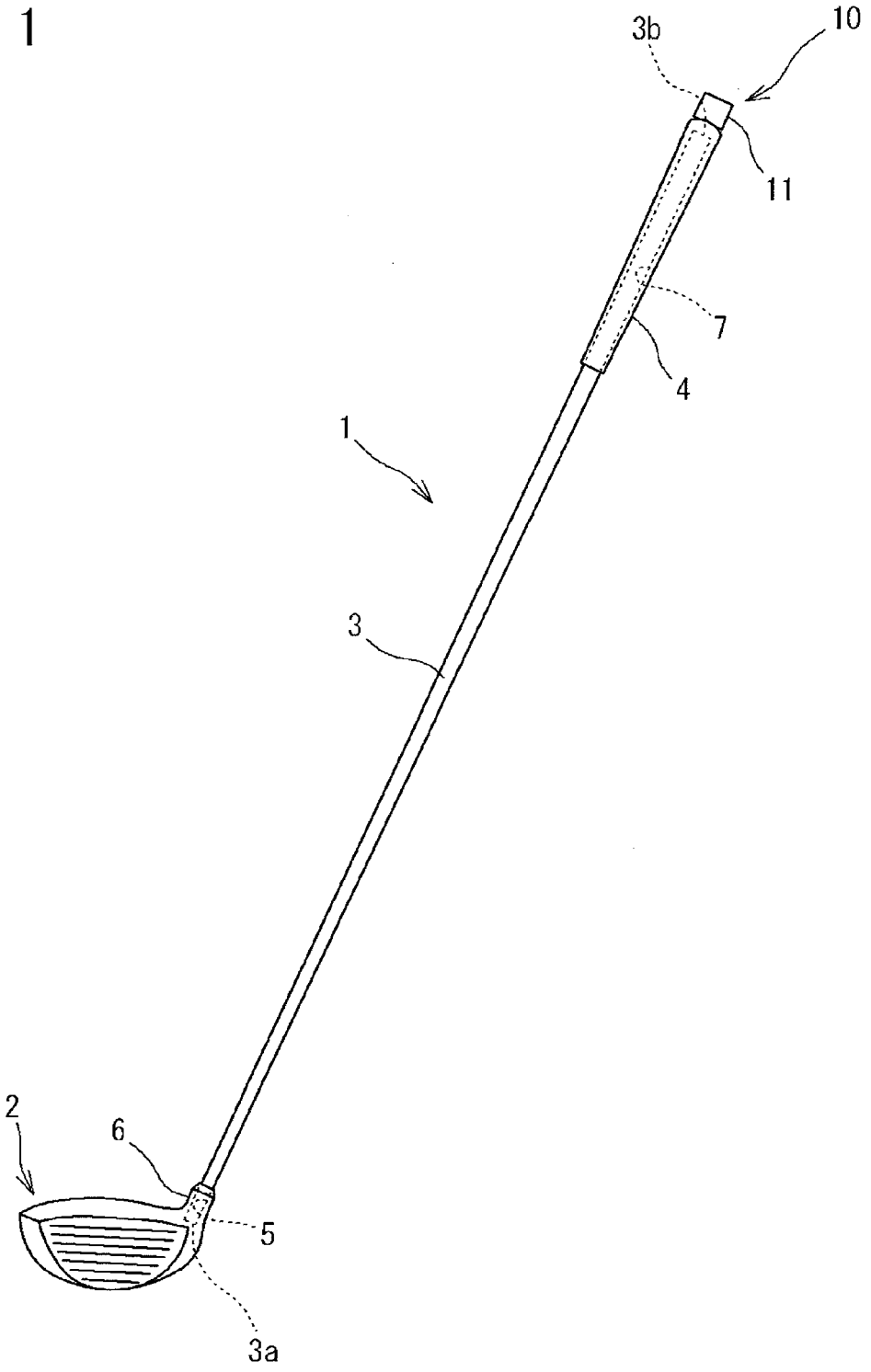
FIG. 1 is an illustrative diagram of one embodiment of a golf club of the present invention.
Figure 2:
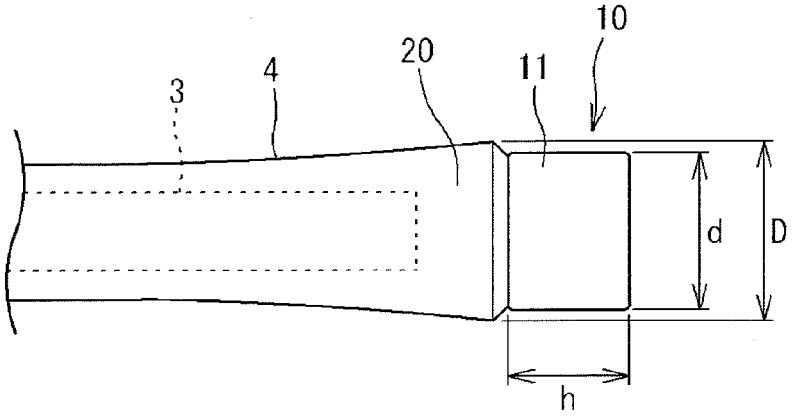
FIG. 2 is an illustrative diagram of relevant parts of a grip of the golf club shown in FIG. 1.

In the following, embodiments of a golf club of the present invention will be described in detail with reference to the accompanying drawings. FIG. 1 is an illustrative diagram of a golf club 1 according to one embodiment of the present invention, and FIG. 2 is an illustrative diagram of relevant parts of a grip 4 of the golf club 1 shown in FIG. 1.

The golf club 1 according to the present embodiment includes a wood-type golf club head 2 having a predetermined loft angle, a shaft 3, and the grip 4. The head 2 has a hosel 6 including a shaft hole 5 to which a tip end 3*a* on the front end side of the shaft 3 is inserted and fixed. A butt end 3*b* at the back end side of the shaft 3 is inserted and fixed in a grip hole 7 of the grip 4. The tip end 3*a* is positioned inside the head 2, and the butt end 3*b* is positioned inside the grip 4.

The head 2 in the present embodiment is a hollow head, and, in the present invention, examples of its material include, but not particularly limited to, titanium, titanium alloys, CFRPs (carbon fiber reinforced plastics), stainless steel, maraging steel, soft iron, and the like. Furthermore, instead of manufacturing the head 2 using a single material, the head 2 may be manufactured by combining multiple materials as appropriate.

The shaft 3 is a carbon shaft, and is manufactured through an ordinary sheet winding process using a prepreg sheet as a material. In more detail, the shaft 3 is a tubular body formed from a laminated body of a fiber reinforced resin layer, and has a hollow structure. It should be noted that, other than a carbon shaft, it is possible to use a steel shaft, or use a shaft formed from a fiber reinforced resin, such as GFRP, BFRP, KFRP, and the like reinforced with fibers other than carbon.

There is no particular limitation in the material and structure of the grip 4, and those commonly used can be adopted as appropriate. Examples of those that can be used include: one that is obtained by blending and kneading oil, carbon black, sulfur, and zinc oxide in natural rubber, and molding and vulcanizing the materials into a predetermined shape; and synthetic rubbers such as EPDM.

In the present invention, although there is no particular limitation in the weight of the grip 4 itself, since a later described sensor section is to be provided on the grip-end edge, the weight is preferably lighter than an ordinary grip 4 by the weight of the sensor section, and can be set as, for example, not smaller than 25 g but not larger than 45 g.

A feature of the present invention is having a sensor section 10 that is arranged on the grip-end edge of the grip 4 as shown in FIG. 2 and that is used for analyzing action of a golf swing. The sensor section 10 includes a sensor casing 11, and the sensor casing 11 has housed therein the sensor, an A/D converter, a CPU, a wireless interface, a wireless antenna, and a power supply. As the power supply, for example, a button type lithium ion battery or the like can be used. The battery may be one that is rechargeable. Furthermore, the sensor section 10 may also include a charging circuit for recharging the battery.

Examples of the sensor housed in the sensor casing 11 include angular velocity sensors capable of measuring angular velocities about three axial directions (x-axial direction, y-axial direction, and z-axial direction), three-axial acceleration sensors, and three-axial magnetic sensors. At least one among these sensors is housed in the sensor casing 11. Analysis or examination of a swing of a golfer using measurement results from the sensor is conducted, and a golf club suitable for the golfer can be selected based on this analysis.

From a standpoint of allowing a golfer to perform a swing as usual as possible, the sensor section 10 is preferably as lightweight as possible. Specifically, its weight is preferably not larger than 15 g, and further preferably not larger than 12 g. Furthermore, the combined weight of the grip 4 and the sensor section 10 is preferably not larger than 55 g, and further preferably not larger than 50 g. Therefore, as the grip 4, one that is more lightweight than an ordinary one is used, and its weight is, for example, preferably not larger than 42 g, and further preferably not larger than 40 g.

The sensor casing 11 has an approximately short cylindrical shape. Its height h can be set as, for example, 5 to 30 mm, and its diameter d can be set as, for example, 10 to 30 mm. Of these ranges, from a standpoint of the sensor section 10 not being obstructive to a swing, the height h is preferably not larger than 27 mm and particularly preferably not larger than 25 mm, and the diameter d is preferably not larger than 25 mm and particularly preferably not larger than 20 mm. The sensor casing 11 in the present embodiment is arranged concentrically to the axial center of the shaft 3, and its outer diameter d is configured to be smaller than a diameter D of the grip-end edge. Specifically, the outer diameter d is configured to be about 2 mm smaller than the diameter D of the grip-end edge. By setting the width or thickness of the sensor casing 11 to be smaller than the size of the grip-end edge in this manner, the sensor section 10 can be prevented from being obstructive during a swing. As a result, a golfer can perform a swing smoothly as usual, and reliability of the swing analysis can be increased.

From a standpoint of preventing the sensor from shifting position due to deformation of the shaft caused by centrifugal force during a swing, unlike a later described buffer part, the sensor casing 11 is preferably manufactured with a stiff material. Specifically, for example, synthetic resins such as MC nylon having a Rockwell hardness of R90 to 130, aluminum alloys, titanium alloys, and magnesium alloys can be used. Among these, from a standpoint of being lightweight, MC nylon is preferably used.

Figure 3:
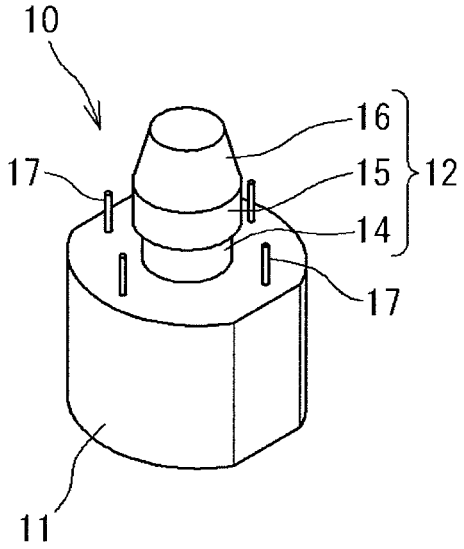
FIG. 3 is a perspective illustrative diagram of a sensor section shown in FIG. 1.
Figure 4:
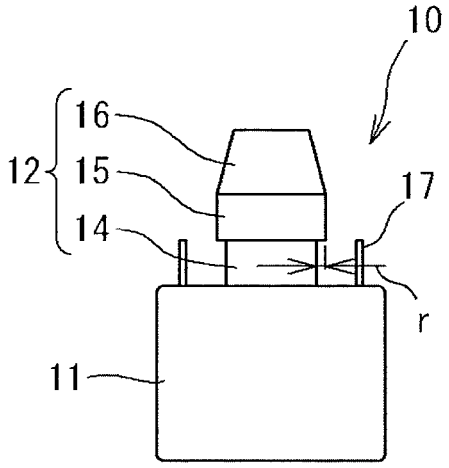
FIG. 4 is an illustrative diagram of a lateral surface of the sensor section shown in FIG. 3.
Figure 5:
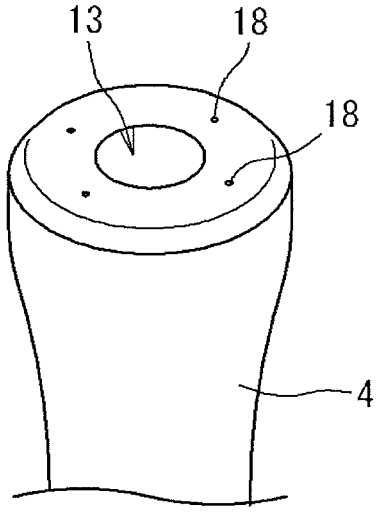
FIG. 5 is an illustrative diagram of a grip end on which the sensor section shown in FIG. 3 is attached.

The sensor casing 11 can be fixed to the grip end using a double-sided tape, an adhesive, a screw, or the like. However, in the present embodiment, as shown in FIGS. 3 to 5, the sensor casing 11 is fixed at the grip end through engagement between a front-end bulged part 12 formed on one end surface of the sensor casing 11 and an engagement concavity 13 that is formed at the grip-end edge and that fixes the front-end bulged part 12 through housing thereof.

The front-end bulged part 12 includes a base 14 disposed so as to stand on one end surface of the sensor casing 11 in a manner coaxial to the sensor casing 11, a large-diameter part 15 that is formed on the front end side of the base 14 and has a diameter larger than the base 14, and a tip-thin tapered part 16 formed on the front end side of the large-diameter part 15.

The engagement concavity 13 that houses the front-end bulged part 12 comprises a cylindrical shaped hole formed at the grip-end edge so as to be coaxial to the axial center of the shaft 3. The diameter of this hole is set to be slightly smaller than the diameter of the large-diameter part 15 such that the front-end bulged part 12 inserted in the hole does not easily fall out during a swing. Specifically, the diameter of the hole is set to be identical to the diameter of the base 14 of the front-end bulged part 12, and to be at least 1.4 mm, preferably at least 2 mm smaller than the diameter of the large-diameter part 15. In other words, a size r (cf. FIG. 4), i.e., a return margin r, of the large-diameter part 15 protruding from the base 14 in a diameter direction is preferably not smaller than 0.7 mm, and further preferably not smaller than 1 mm.

It should be noted that, for the purpose of fixing with further certainty, the front-end bulged part 12 may be inserted (press fit) into the engagement concavity 13 after applying an adhesive to an outer circumference of the front-end bulged part 12 and/or an inner circumference of the engagement concavity 13.

In the present embodiment, four round rod shaped pins 17 are disposed in a protruding manner at equal intervals on the surrounding area of the front-end bulged part 12. In addition, at the grip-end edge, four pin holes 18 are formed in a manner corresponding to the pins 17. When inserting the front-end bulged part 12 into the engagement concavity 13, by also piercing or inserting the pins 17 into the pin holes 18, it is possible to prevent rotation of the sensor section 10 during a swing with certainty. If the sensor section 10 rotates by a swing, shifting of positions of various sensors in the sensor casing 11 occurs, and accuracy of repeated measurement may deteriorate. However, by using the pins 17 as described above, it is possible to prevent such deterioration of measurement accuracy.

In the present invention, although there is no particular limitation in the lengths of the pins 17, from a standpoint of rotation prevention effect, the lengths are preferably not smaller than 1 mm, and further preferably not smaller than 3 mm. On the other hand, since the pins 17 are thin and may break and not exert their desired performance if they are too long, their lengths are preferably not larger than 20 mm, and further preferably not larger than 15 mm. Furthermore, in the present invention, although there is no particular limitation also in the thicknesses of the pins 17, the thicknesses are ordinarily about 1 to 2 mm.

A buffer part for reducing shock generated when hitting a ball is provided between the shaft 3 of the golf club 1 and the sensor section 10, and, in the present embodiment, the buffer part comprises a large-thickness part 20 of the grip-end side edge part of the grip 4. From a standpoint of reducing shock, a larger thickness is preferable for the large-thickness part 20. More specifically, the thickness is preferably not smaller than 4 mm, and further preferably not smaller than 5 mm. On the other hand, if the thickness is too large, the grip 4 becomes heavy and a swing may become affected, and the large-thickness part 20 itself may vibrate. Therefore, the thickness of the large-thickness part 20 is preferably not larger than 10 mm, and further preferably not larger than 8 mm.

Furthermore, from a standpoint of absorbing shock, the large-thickness part 20 as the buffer part is preferably formed from a soft material. More specifically the large-thickness part 20 has a shore A hardness of preferably not larger than 80°, and further preferably not larger than 60°. On the other hand, if the large-thickness part 20 is too soft, the large-thickness part 20 itself vibrates and measurement accuracy deteriorates due to shifting of positions of sensors in the sensor section 10. Therefore, the large-thickness part 20 has a shore A hardness of preferably not smaller than 30°, and further preferably not smaller than 40°.

Figure 6:
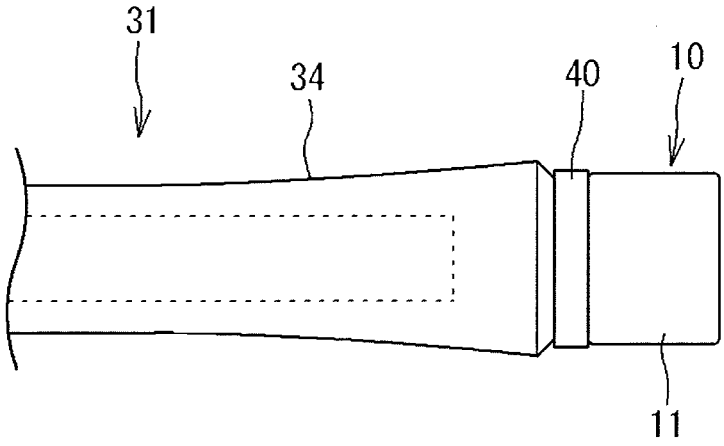
FIG. 6 is an illustrative diagram of relevant parts of a grip of a golf club according to another embodiment of the present invention.

FIG. 6 is an illustrative diagram of relevant parts of a grip 34 of a golf club 31 according to another embodiment of the present invention. In the embodiment shown in FIGS. 1 and 2, a large-thickness part at a grip-end side edge part of the grip functions as a buffer part. However, when a predetermined thickness cannot be obtained at the grip-end side edge part due to design of the grip or restrictions in manufacturing, a buffer material 40 may be arranged between the grip-end edge and the sensor section 10 as a buffer part. The buffer material 40 is a washer-like member having a hole (not shown) at its center, and the front-end bulged part 12 of the sensor casing 11 penetrates the hole at the center so as to be engaged with the engagement concavity at the grip-end edge.

Examples of the material of the large-thickness part 20 and the buffer material 40 include synthetic rubbers such as neoprene rubber, natural rubbers, synthetic resins such as polyester, and leather.

EXPERIMENTAL EXAMPLE

Next, testers were asked to swing golf clubs whose specifications at the above described buffer part were changed in various manners, and shock reducing effect of the buffer part was evaluated by measuring vibration using a small-sized three-axial acceleration pickup. The results are shown in Table 1. The used golf clubs were wood type golf clubs shown in FIG. 1, and their main specifications are shown in the following.

Club length (excluding the sensor section): 1143 mm

Head weight: 190 g

Shaft weight: 64 g

Club weight (excluding the sensor section): 300 g

In addition, the sensor section had a short cylindrical shape with a height of 19 mm, a diameter of 25 mm, and a weight of 10 g.

TABLE 1

| | Grip end thickness [mm] | Buffer material thickness [mm] | Buffer material substance [mm] | Shore A hardness of buffer material | Shock reducing effect | Remarks |
|---|---|---|---|---|---|---|
| Experimental example 1 | 2 | — (none) | | | X | Insufficient thickness for buffer part |
| Experimental example 2 | 3 | — | | | X | Insufficient thickness for buffer part |
| Experimental example 3 | 3 | 1 | EPDM | 50 | Δ | Insufficient thickness for buffer part |
| Experimental example 4 | 3 | 2 | EPDM | 50 | ○ | |
| Experimental example 5 | 3 | 2 | Urethane rubber | 30 | ○ | Lower limit of hardness of buffer material |
| Experimental example 6 | 3 | 2 | Silicone rubber | 75 | ○ | Upper limit of hardness of buffer material |
| Experimental example 7 | 3 | 2 | Low hardness urethane | 15 | X | Insufficient hardness for buffer material |
| Experimental example 8 | 3 | 2 | SUS304 | 90 or larger | X | Excessive hardness for buffer material |
| Experimental example 9 | 4 | — | | | Δ | Insufficient thickness for buffer part |
| Experimental example 10 | 4 | 1 | EPDM | 50 | ○ | |
| Experimental example 11 | 5 | — | | | ○ | |
| Experimental example 12 | 5 | 1 | EPDM | 50 | ◎ | |

From Table 1, it can be understood that, when the large-thickness part is to be employed at the grip end as the buffer part, about 5 mm of thickness is required for the large-thickness part. Furthermore, it can be understood that, when the buffer material is to be employed as the buffer part, it is sufficient when the thickness of the buffer material is set so as to obtain about 5 mm of total thickness together with the large-thickness part. Furthermore, as the hardness of the buffer material, it can be understood that a shore A hardness of 15° is insufficient, and a hardness of 90° is too hard. Therefore, it can be understood that a preferable range of the hardness of the buffer material is 30 to 75°.

In addition, an experiment was conducted regarding the relationship between ease of swinging a club and the total weight of the grip and the sensor section. Specifications regarding grip weight, sensor section weight, etc., were as shown in Table 2. The weight of the golf club without the grip and the sensor section was 260 g. Evaluation of ease of swinging was conducted by asking 10 golfers whose handicaps range from 0 to 8 to actually swing a golf club and perform a 5-scale evaluation. A score given by the largest number of golfers was defined as an evaluation score.

TABLE 2

| Grip weight [g] | Sensor weight [g] | Grip + sensor weight [g] | Club weight [g] | Club balance | Ease of swinging [score] |
|---|---|---|---|---|---|
| 50 | — (none) | 50 | 310 | D2 | 5 |
| 50 | 10 | 60 | 320 | D0 | 4 |
| 40 | 10 | 50 | 310 | D2 | 5 |
| 25 | 10 | 35 | 295 | D5 | 3 |

From Table 2, it can be understood that, even when the sensor section is provided, the same degree of ease swinging as that of a golf club without a sensor section can be obtained by reducing weight of the grip by the amount of weight of the sensor section.

Figure 7:
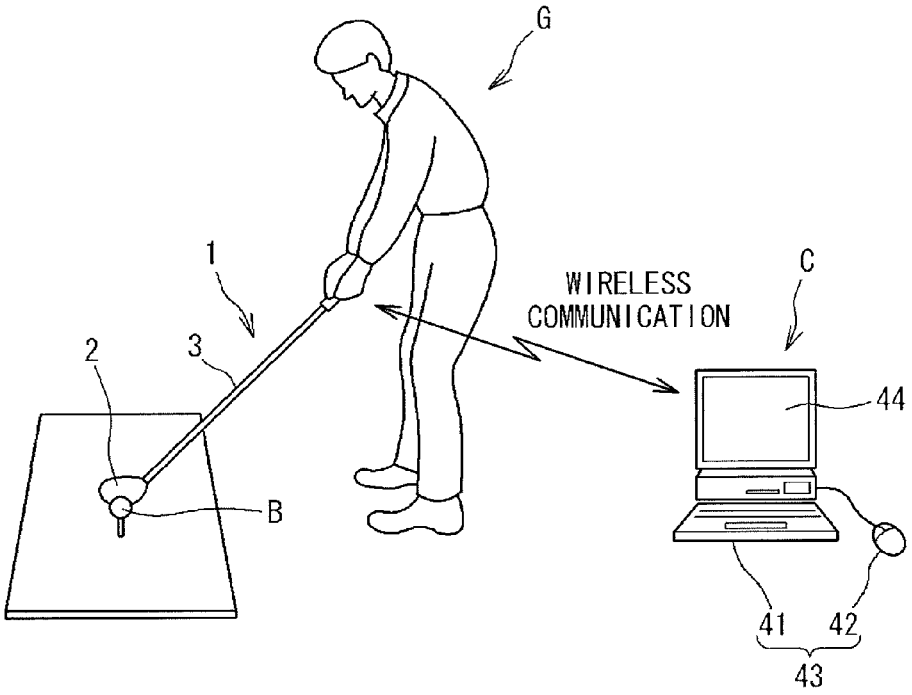
FIG. 7 is for describing a method for measuring a swing by using a golf club of the present invention.

In the following, one example of swing measurement using the golf club of the present invention will be described. FIG. 7 is for describing a method for measuring a swing by using the golf club of the present invention. In this method, as shown in FIG. 7, a golfer hoping for fitting of a golf club is asked to actually swing a golf club, and characteristics of the golfer's swing is measured from the swing. For this measurement, the sensor section provided at the grip-end edge of the grip is used. In the example shown in FIG. 7, a golfer G is a right-handed person and is in an address state immediately before initiating a swing to hit a ball B set at a predetermined position.

The sensor in the sensor section is wireless, and measured data are transmitted through wireless communication to a wireless receiver (not shown) built in a computer C that functions as a data analysis device. For the wireless communication, for example, standards and technologies of Bluetooth (Registered trademark) can be used. The wireless receiver that receives signals from the sensor section includes a wireless antenna, a wireless interface, a CPU, and a network interface.

The computer C that functions as a data analysis device includes an input section 43 consisting of a keyboard 41 and a mouse 42, and a display section 44. In addition, although not shown, the computer C includes a hard disk, a memory, a CPU, and a network interface.

Data transmitted from the sensor section is received by the wireless interface through the wireless antenna on the wireless receiver side. The received data is computationally processed by the CPU of the computer C.

Data sent to the computer C are stored in a memory resource such as the hard disk. The hard disk has stored therein a program, data, and the like required for data processing etc. The program causes the CPU to execute required data processing. The CPU is capable of executing various computation processes, and a calculated result is outputted to the display section 44, or a printer that is not shown, etc.

[Other Modifications]

It should be understood that the embodiments disclosed herein are merely illustrative and not restrictive in all aspects. The scope of the present invention is defined by the scope of the claims rather than by the meaning described above, and is intended to include meaning equivalent to the scope of the claims and all modifications within the scope.

For example, in the above described embodiment, although four pins for preventing rotation of the sensor section are disposed on the sensor casing in a protruding manner, the sufficient number of the pins is one or more. However, from a standpoint of preventing rotation of the sensor section with further certainty, having multiple pins, for example, two or more, is preferable, and having three or more pins is further preferable. When using multiple pins, the pins are preferably arranged at equal intervals in the circumferential direction.

Furthermore, in the above described embodiment, although the pins are configured to pierce pin holes formed on the grip-end edge, instead of forming such pin holes, it is also possible to manufacture the front ends of the pins to be sharp and have the pins directly pierce the grip-end edge. In addition, the shape of the pins is not limited to the round rod shape, and other shapes such as a square rod shape may also be used.

Furthermore, in the above described embodiment, although the shape of the sensor casing is a short cylindrical shape, other shapes such as a square pillar shape may also be used.

DESCRIPTION OF THE REFERENCE CHARACTERS

1 golf club
2 head
3 shaft
4 grip
10 sensor section
11 sensor casing
12 front-end bulged part
13 engagement concavity
17 pin
20 large-thickness part
40 buffer material

What is claimed is:

1. A golf club having a head disposed at a front end of a shaft and having a grip disposed at a back end of the shaft, the golf club comprising a sensor section arranged on a grip-end edge of the grip and used for analyzing action of a golf swing, wherein the sensor section includes at least one of an angular velocity sensor, an acceleration sensor, and a magnetic sensor, and a sensor casing that houses the sensor, wherein a pin capable of piercing the grip-end edge is disposed at one end surface of the sensor casing in a protruding manner, and wherein a plurality of the pins are disposed in a protruding manner on an area surrounding a front-end bulged part formed on one end surface of the sensor casing.

2. The golf club according to claim 1, wherein the total weight of the grip and the sensor section is not larger than 55 g.

3. The golf club according to claim 1, wherein the weight of the sensor section is not larger than 15 g.

4. The golf club according to claim 1, further comprising a temperature sensor.

5. The golf club according to claim 1, wherein the sensor casing has a shape of a short cylinder arranged concentrically to an axial center of the shaft, and an outer diameter of the short cylinder is smaller than a diameter of the grip-end edge.

6. The golf club according to claim 1, wherein the sensor casing is formed from a synthetic resin whose Rockwell hardness is R90 to 130.

7. The golf club according to claim 1, wherein an engagement concavity for housing and fixing the front-end bulged part is formed at the grip-end edge.

8. A golf club having a head disposed at a front end of a shaft and having a grip disposed at a back end of the shaft, the golf club comprising a sensor section arranged on a grip-end edge of the grip and used for analyzing action of a golf swing, wherein the sensor section includes a sensor casing that houses a sensor, wherein a front-end bulged part is formed on one end surface of the sensor casing, and an engagement concavity for housing and fixing the front-end bulged part is formed at the grip-end edge, wherein a pin capable of piercing the grip-end edge is disposed at the one end surface of the sensor casing in a protruding manner.

* * * * *